US006988503B1

(12) United States Patent
Smith

(10) Patent No.: US 6,988,503 B1
(45) Date of Patent: Jan. 24, 2006

(54) METHOD AND APPARATUS FOR CONTAINING CLEANING FLUIDS WHILE CLEANING AIR COOLER FIN TUBES

(76) Inventor: Gary Ray Smith, P.O. Box 1247, Odem, TX (US) 78370

( * ) Notice: Subject to any disclaimer, the term of this patent is extended or adjusted under 35 U.S.C. 154(b) by 0 days.

(21) Appl. No.: 11/004,458

(22) Filed: Dec. 3, 2004

Related U.S. Application Data

(60) Provisional application No. 60/527,263, filed on Dec. 6, 2003.

(51) Int. Cl.
*B08B 9/02* (2006.01)
*B08B 9/027* (2006.01)

(52) U.S. Cl. ..... 134/22.1; 134/22.12; 134/22.18; 134/24; 134/104.2; 134/166 R; 134/186

(58) Field of Classification Search ..... 134/22.1, 134/22.11, 22.12, 22.18, 24, 104.2, 115 R, 134/166 R, 169 R, 170, 186

See application file for complete search history.

(56) References Cited

U.S. PATENT DOCUMENTS 4,551,181 A * 11/1985 Stearman ..... 134/22.11
5,336,331 A * 8/1994 Jenkins ..... 134/22.11
5,499,639 A * 3/1996 Williams, Jr. ..... 134/7

* cited by examiner

*Primary Examiner*—Michael Barr
*Assistant Examiner*—Saeed Chaudhry
(74) *Attorney, Agent, or Firm*—George S. Gray

(57) ABSTRACT

Equipment and methods are provided for combining with a typical air cooler having numerous fin tubes, the combination allowing the containment of cleaning fluid used while cleaning the fin tubes with high pressure liquid cleaning devices in which cleaning fluid is discharged into one end of each fin tube and out the other. Two enclosures are attached to each end of the air cooler, with one enclosure having cleaning tool access portions for separately exposing each of at least two pluralities of the fin tubes while continuing to cover the remaining fin tube pluralities. Cleaning fluid splashed at the cleaning fluid entry end of the air cooler is captured and drained by the first enclosure, while cleaning fluid exiting the fin tubes at the cleaning fluid discharge end of the air cooler is captured and drained by the second enclosure.

24 Claims, 10 Drawing Sheets

METHOD AND APPARATUS FOR CONTAINING CLEANING FLUIDS WHILE CLEANING AIR COOLER FIN TUBES

CROSS-REFERENCE TO RELATED APPLICATION

This application claims priority from U.S. Provisional Patent Application Ser. No. 60/527,263, filed Dec. 6, 2003, the inventor being Gary Ray Smith.

BACKGROUND OF THE INVENTION

1. Field of the Invention

The field of the invention is the petrochemical industry, and more particularly, the cleaning of fin tubes in air coolers.

2. Description of Related Art

The term "air cooler" as used herein refers to certain apparatus in common use in the petrochemical industry. Two air coolers 10 are shown in a typical installation in FIG. 1 wherein two air cooler bays are shown. FIG. 2 is an end view of another typical air cooler bay 24. In a typical usage, overhead vapor from a refinery distillation tower is piped through inlets 12 into an inlet header 14. The inlet header is in communication with the inlet ends (first ends) of numerous fin tubes 16, and the vapor moves through the fin tubes and out the outlet ends (second ends) of the fin tubes into a return (or outlet) header 18 for subsequent discharge through outlets 20 back into the refinery system. The inlet and outlet headers are part of the air cooler frame 22 that holds the fin tubes.

The crosses in FIG. 2 represent the centers of a typical arrangement of the fin tubes, which are in rows and equally spaced. The crosses also represent the centers of holes in the inlet header and outlet header that are in direct alignment with each of the fin tubes. In normal use these holes are closed by bull plugs. The fin tubes are typically spaced on approximately 2⅜ inch centers and typically have one-half inch inside diameters. Each fin tube has exterior fins about their outside circumference, the fins being spaced by approximately one-sixteenth inch.

In a typical operation the vapors from the distillation tower are cooled, while in the fin tubes, by blowing air across the fin tubes using fans. As the vapors cool, it is common for carbonate scale and other materials to be deposited in the fin tube interiors.

The air cooler fin tubes 16 are typically cleaned by a cleaning tool having a fluid discharge end that is insertable through an open inlet header hole into the aligned fin tube inlet end. A typical cleaning tool is a line mole having a flexible hose with a discharge tip. Cleaning fluid is pumped into the hose at high pressure and is discharged through the discharge tip and against the adjacent interior wall of the fin tube being cleaned. The discharged cleaning fluid and dislodged material, e.g. carbonate scale buildup, exits the fin tube at the fin tube second end, and the majority of such cleaning fluid and dislodged material continue through the aligned hole in the air cooler outlet header.

A significant operational, safety and regulatory concern related to this cleaning process is the cleaning fluid and dislodged material being discharged on to the surrounding equipment or the ground. Operators have attempted to isolate the area subject to splashing and exiting fluids and dislodged materials, by temporarily isolating and/or covering the area using sheets of plywood, etc. All current methods of controlling the splashing and exiting fluids and dislodged materials are labor and material intensive, making the process time consuming and expensive.

Equipment is needed that will install quickly and capture the splashing and exiting cleaning fluids and dislodged materials while the air cooler fin tubes are being cleaned.

SUMMARY OF THE INVENTION

My invention provides equipment that installs quickly and captures the splashing and exiting cleaning fluids and dislodged materials while air cooler fin tubes are being cleaned using high pressures cleaning devices.

For an air cooler to be cleaned by a cleaning apparatus having a fluid discharge end, I have provided, in one exemplary embodiment, a fluid containment apparatus for attachment to the air cooler, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, the apparatus comprising: a first enclosure having a frame, a flexible housing having an interior, the housing being supported by the frame, and a drain member, the frame attaching the housing to the air cooler frame first end, the housing having a plurality of access portions, each access portion being openable to expose a number of the air cooler frame first end holes to cleaning apparatus discharge end entry, the flexible housing blocking such access to the remaining air cooler frame first end holes, such access portion being closable to block access to such exposed air cooler frame first end holes, the flexible housing being attached such that all cleaning fluid discharged from an air cooler frame first end hole is received by the housing and directed by the housing to the drain member; and a second enclosure having a frame, a flexible housing having an interior, the housing being supported by the frame, and a drain member, the frame attaching the housing to the air cooler frame second end such that cleaning fluid exiting one or more of the fin tube second ends through one or more of the air cooler frame second end holes is received by the housing and directed by the housing to the drain member.

In some exemplary embodiments of my invention, the apparatus further comprises an access mechanism for providing access to the second enclosure housing interior, the access mechanism being openable and closable.

In some exemplary embodiments of my invention, the apparatus further comprises a splash control member, the splash control member being positioned within the second enclosure housing interior and positioned such that cleaning fluid exiting one or more of the air cooler frame second end holes strikes the splash control member.

In some exemplary embodiments of my invention, the air cooler frame first end has a top, and the air cooler further comprises a conduit member attached to the air cooler frame first end top, the first enclosure housing further comprising a conduit member accommodation mechanism, such that the conduit member is spatially accommodated by the conduit member accommodation mechanism when the first enclosure housing is attached to the air cooler frame first end.

In some exemplary embodiments of my invention, the air cooler frame second end has a top, and the air cooler further comprises a conduit member attached to the air cooler frame second end top, the second enclosure housing further comprising a conduit member accommodation mechanism, such that the conduit member is spatially accommodated by the conduit member accommodation mechanism when the second enclosure housing is attached to the air cooler frame second end.

In some exemplary embodiments of my invention, the air cooler frame first end has a bottom, and the air cooler further comprises a conduit member attached to the air cooler frame first end bottom, the first enclosure housing further comprising a conduit member accommodation mechanism, such that the conduit member is spatially accommodated by the conduit member accommodation mechanism when the first enclosure housing is attached to the air cooler frame first end.

In some exemplary embodiments of my invention, the air cooler frame second end has a bottom, and the air cooler further comprises a conduit member attached to the air cooler frame second end bottom, the second enclosure housing further comprising a conduit member accommodation mechanism, such that the conduit member is spatially accommodated by the conduit member accommodation mechanism when the second enclosure housing is attached to the air cooler frame second end.

In some exemplary embodiments of my invention, the first enclosure housing access portions are simultaneously openable such that all frame first end holes are exposed.

For an air cooler to be cleaned by a cleaning apparatus having a fluid discharge end, my invention provides, in some exemplary embodiments, a fluid containment apparatus for attachment to the air cooler, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, the apparatus comprising: means for enclosing the air cooler frame first end while providing openable separate access to each of at least two pluralities of the air cooler frame first end holes for the cleaning apparatus discharge end to enter, the means blocking such access to the remaining air cooler frame first end hole pluralities during access to a first of the pluralities, and to the first of the pluralities during access to a second of the pluralities, the means being attached such that all cleaning fluid discharged from an air cooler frame first end hole is received by, and drained from, such means; and means for enclosing the air cooler frame second end such that cleaning fluid exiting one or more of the fin tube second ends through one or more of the air cooler frame second end holes is received by such means and drained from such means.

In some exemplary embodiments of my invention, the apparatus further comprises means for providing access to the means for enclosing the frame second end, such means for providing access being openable and closable.

In some exemplary embodiments of my invention, the apparatus further comprises splash control means, the splash control means being positioned within the means for enclosing the frame second end and positioned such that cleaning fluid exiting one or more of the air cooler frame second end holes strikes the splash control means.

In some exemplary embodiments of my invention, the air cooler frame first end has a top, and the air cooler further comprises a conduit member attached to the air cooler frame first end top, the means for enclosing the frame first end further comprising means for accommodating the conduit member, such that the conduit member is spatially accommodated by the means for accommodating the conduit member when the means for enclosing the frame first end is attached to the air cooler frame first end.

In some exemplary embodiments of my invention, the air cooler frame second end has a top, and the air cooler further comprises a conduit member attached to the air cooler frame second end top, the means for enclosing the frame second end further comprising means for accommodating the conduit member, such that the conduit member is spatially accommodated by the means for accommodating the conduit member when the means for enclosing the frame second end is attached to the air cooler frame second end.

In some exemplary embodiments of my invention, the air cooler frame first end has a bottom, and the air cooler further comprises a conduit member attached to the air cooler frame first end bottom, the means for enclosing the frame first end further comprising means for accommodating the conduit member, such that the conduit member is spatially accommodated by the means for accommodating the conduit member when the means for enclosing the frame first end is attached to the air cooler frame first end.

In some exemplary embodiments of my invention, the air cooler frame second end has a bottom, and the air cooler further comprises a conduit member attached to the air cooler frame second end bottom, the means for enclosing the frame second end further comprising means for accommodating the conduit member, such that the conduit member is spatially accommodated by the means for accommodating the conduit member when the means for enclosing the frame second end is attached to the air cooler frame second end.

In some exemplary embodiments of my invention, the means for enclosing the frame first end is optionally openable such that all frame first end holes are exposed.

For an air cooler to be cleaned by a cleaning apparatus having a fluid discharge end, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, I have provided, in some exemplary embodiments, a method for containing the cleaning fluids comprising: enclosing the frame first end with a first enclosure; enclosing the frame second end with a second enclosure for receiving cleaning fluid exiting one or more of the fin tube second ends through one or more of the air cooler frame second end holes, and draining the received cleaning fluid from the second enclosure; opening a portion of the first enclosure to expose only a first plurality of the frame first end holes to cleaning apparatus discharge end entry and cleaning fluid discharge from the cleaning apparatus discharge end, the first enclosure continuing to block access to at least one additional pluralities of frame first end holes; discharging cleaning fluid from the cleaning apparatus discharge end into each of the first plurality of frame first end holes, the first enclosure capturing and draining cleaning fluid discharged proximate the frame first end holes; closing the opened portion of the first enclosure; opening a portion of the first enclosure to expose only a second plurality of the frame first end holes to cleaning apparatus discharge end entry and cleaning fluid discharge from the cleaning apparatus discharge end, the first enclosure blocking access to the first plurality of frame first end holes and discharging cleaning fluid from the cleaning apparatus discharge end into each of the second plurality of frame first end holes the first enclosure capturing and draining cleaning fluid discharged proximate the frame first end holes.

In some exemplary embodiments of my invention, the method further comprises providing openable and closable access to within the second enclosure.

In some exemplary embodiments of my invention, the method further comprises positioning a splash control mechanism within the second enclosure such that cleaning fluid exiting one or more of the air cooler frame second end holes strikes the splash control mechanism.

In some exemplary embodiments of my invention, wherein the air cooler frame first end has a top, and the air cooler further comprises a conduit member attached to the air cooler frame first end top, the method further comprises opening a conduit accommodation mechanism such that the conduit member is spatially accommodated by the first enclosure when the first enclosure encloses the air cooler frame first end.

In some exemplary embodiments of my invention, wherein the air cooler frame second end has a top, and the air cooler further comprises a conduit member attached to the air cooler frame second end top, the method further comprises opening a conduit accommodation mechanism such that the conduit member is spatially accommodated by the second enclosure when the second enclosure encloses the air cooler frame second end.

In some exemplary embodiments of my invention, wherein the air cooler frame first end has a bottom, and the air cooler further comprises a conduit member attached to the air cooler frame first end bottom, the method further comprises opening a conduit accommodation mechanism such that the conduit member is spatially accommodated by the first enclosure when the first enclosure encloses the air cooler frame first end.

In some exemplary embodiments of my invention, wherein the air cooler frame second end has a bottom, and the air cooler further comprises a conduit member attached to the air cooler frame second end bottom, the method further comprises opening a conduit accommodation mechanism such that the conduit member is spatially accommodated by the second enclosure when the second enclosure encloses the air cooler frame second end.

In some exemplary embodiments of my invention, the method further comprises opening portions of the first enclosure such that all pluralities of frame first end holes are simultaneously exposed for cleaning apparatus discharge end entry.

DETAILED DESCRIPTION OF EXEMPLARY EMBODIMENTS

Figure 1:
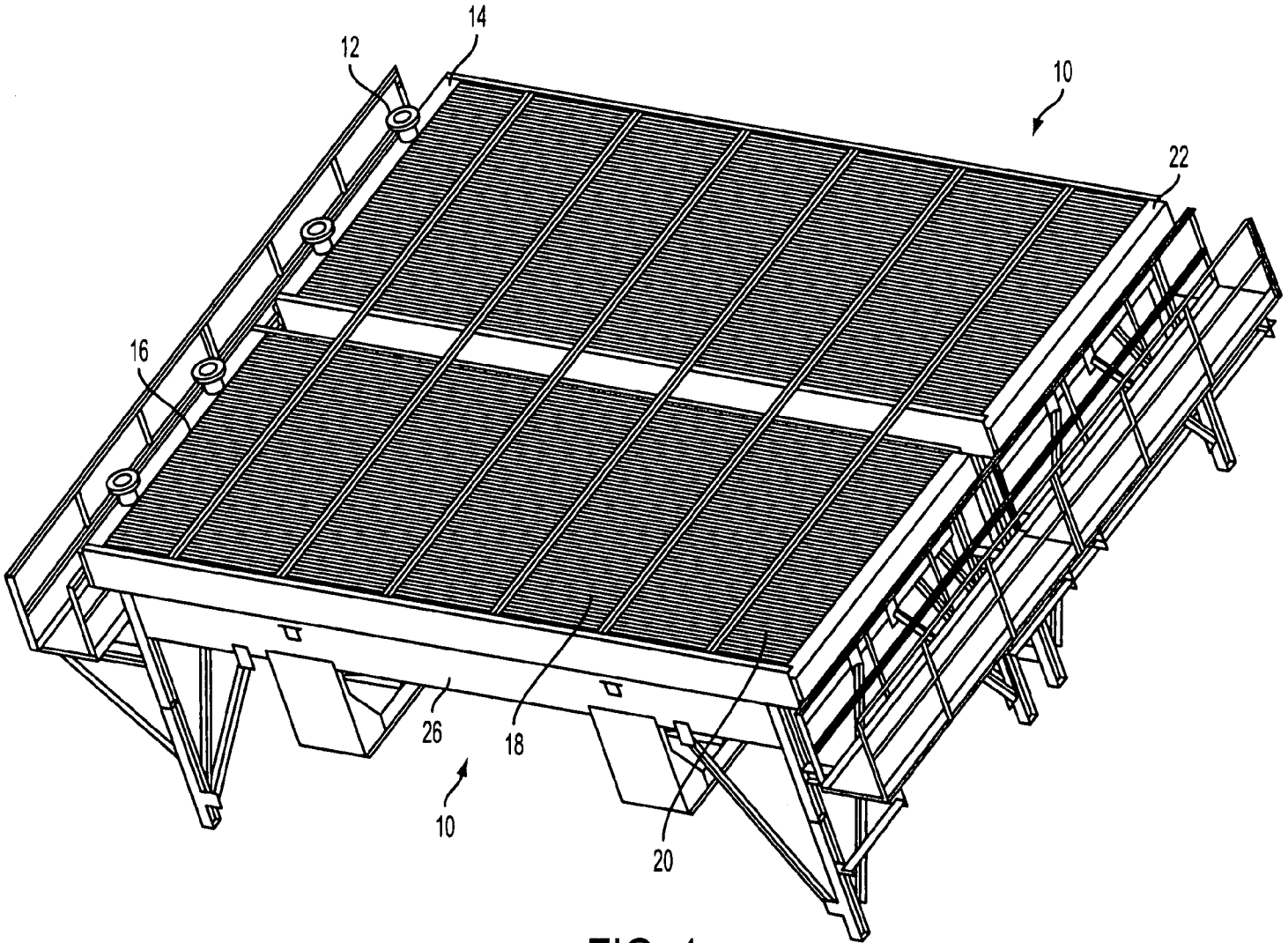
FIG. 1 PRIOR ART
FIG. 1 is a prior art double bay air cooler installation.
Figure 2:
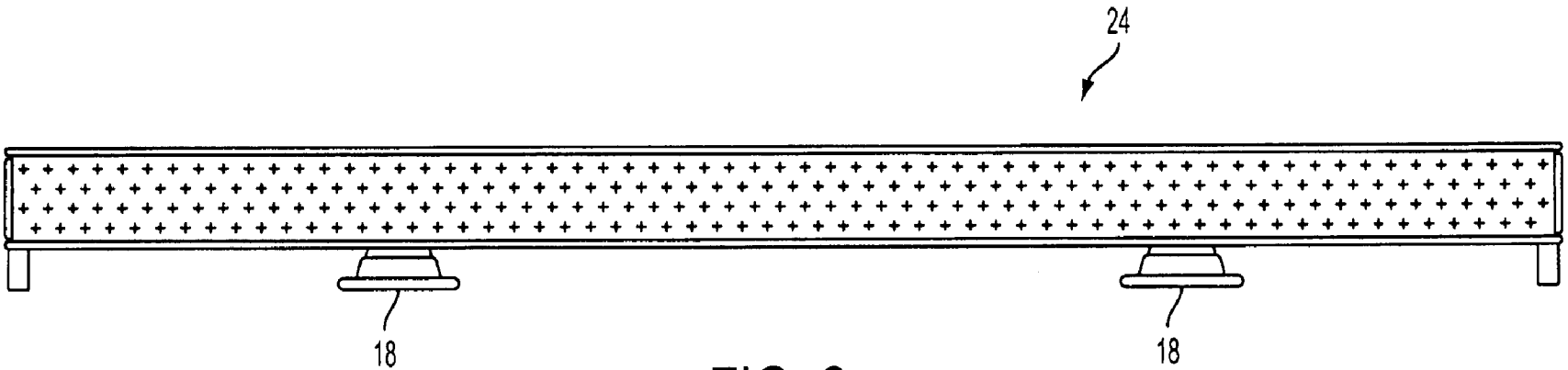
FIG. 2 PRIOR ART
FIG. 2 is an end view of a prior art air cooler, with crosses representing the centers of header holes and fin tubes.

The following discussion describes in detail exemplary embodiments of the invention. This discussion should not be construed, however, as limiting the invention to those particular embodiments. Practitioners skilled in the art will recognize numerous other embodiments as well.

FIGS. 3–9 depict an exemplary embodiment 30 of the current invention wherein a first enclosure 32 is attached to the air cooler 10 frame inlet header 34 (i.e. the air cooler frame first end). The air cooler frame 26 is supported by legs 29. The first enclosure has a frame and a flexible housing 36 supported by the frame. In this exemplary embodiment, the first enclosure frame includes three horizontally-oriented, transverse, elongated members 38,40,42, three horizontally-oriented, telescoping, elongated members 44,46,48 positioned in general alignment with the fin tubes, and three vertically-oriented, telescoping, elongated members 50,52, 54, each hinged to one of the aligned members 44,46,48 to form three hinged legs.

In such an embodiment, the hinged legs extend vertically to the ground and can be telescopically adjusted by removing pins 58 and reinserting after telescoping the vertical members 50,52,54. When the vertical members are properly adjusted, the horizontally-oriented aligned members 44,46, 48 extend over the top of the first enclosure housing 36 where they are each fastened to the first transverse member 38 using a pin 60. The aligned members 44,46,48 can be telescopically adjusted by removing pins 59 and reinserting after telescoping the aligned members to the desired length.

In this exemplary embodiment, the first transverse member 38 is positioned adjacent the air cooler frame first end top. The second transverse member 40 is positioned against the air cooler frame first end bottom. The first and second transverse members 38,40 are held in such position by binding the first ends of such members with a first elastic member 62 and the second ends of such members with a second elastic member 64. In this exemplary embodiment the first and second elastic members used are typically referred to as "bungee" cords, although other support straps or retainers can be used.

Figure 3:
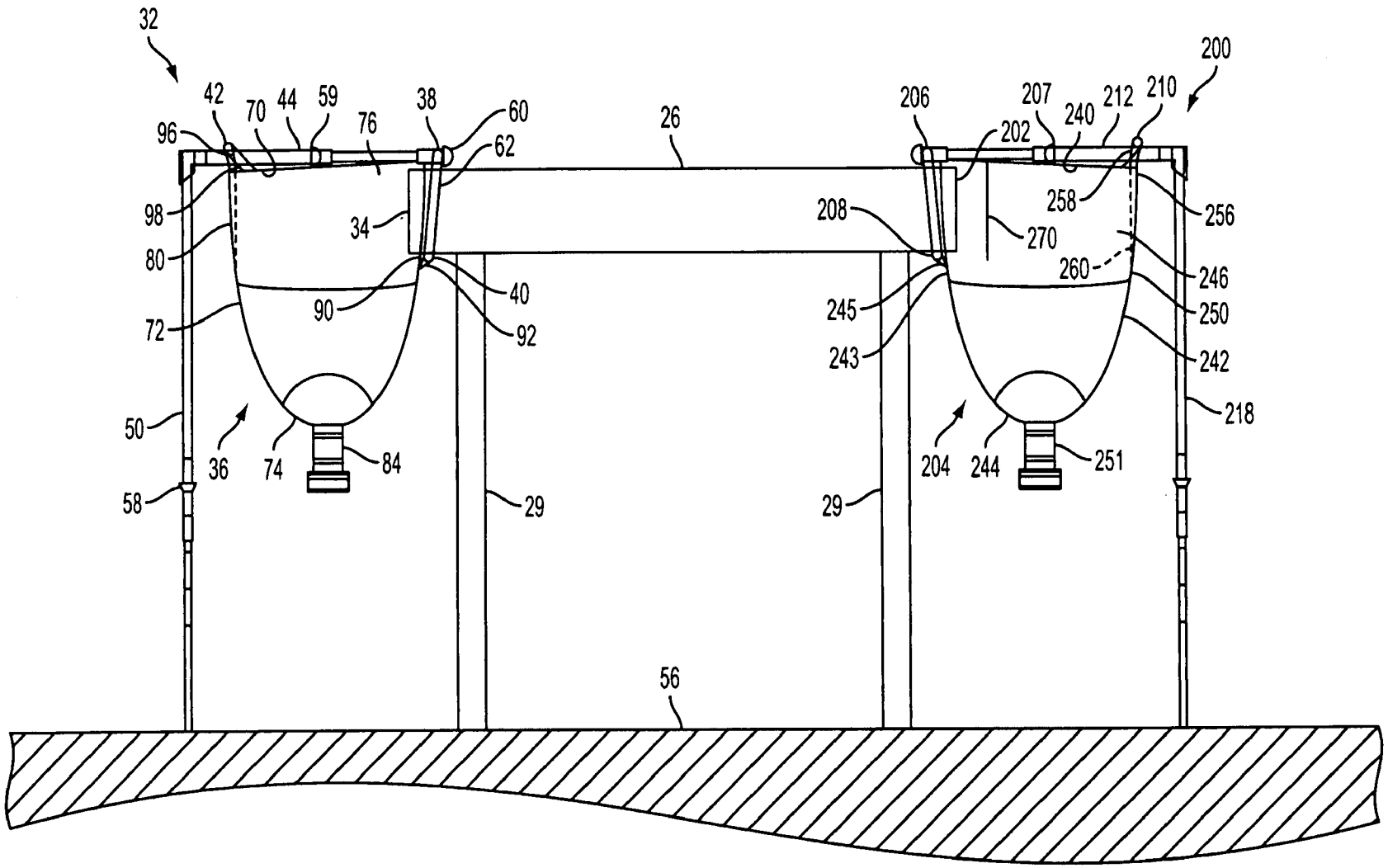
FIG. 3 is a side view of the present invention attached to a symbolic representation of an air cooler.
Figure 4:
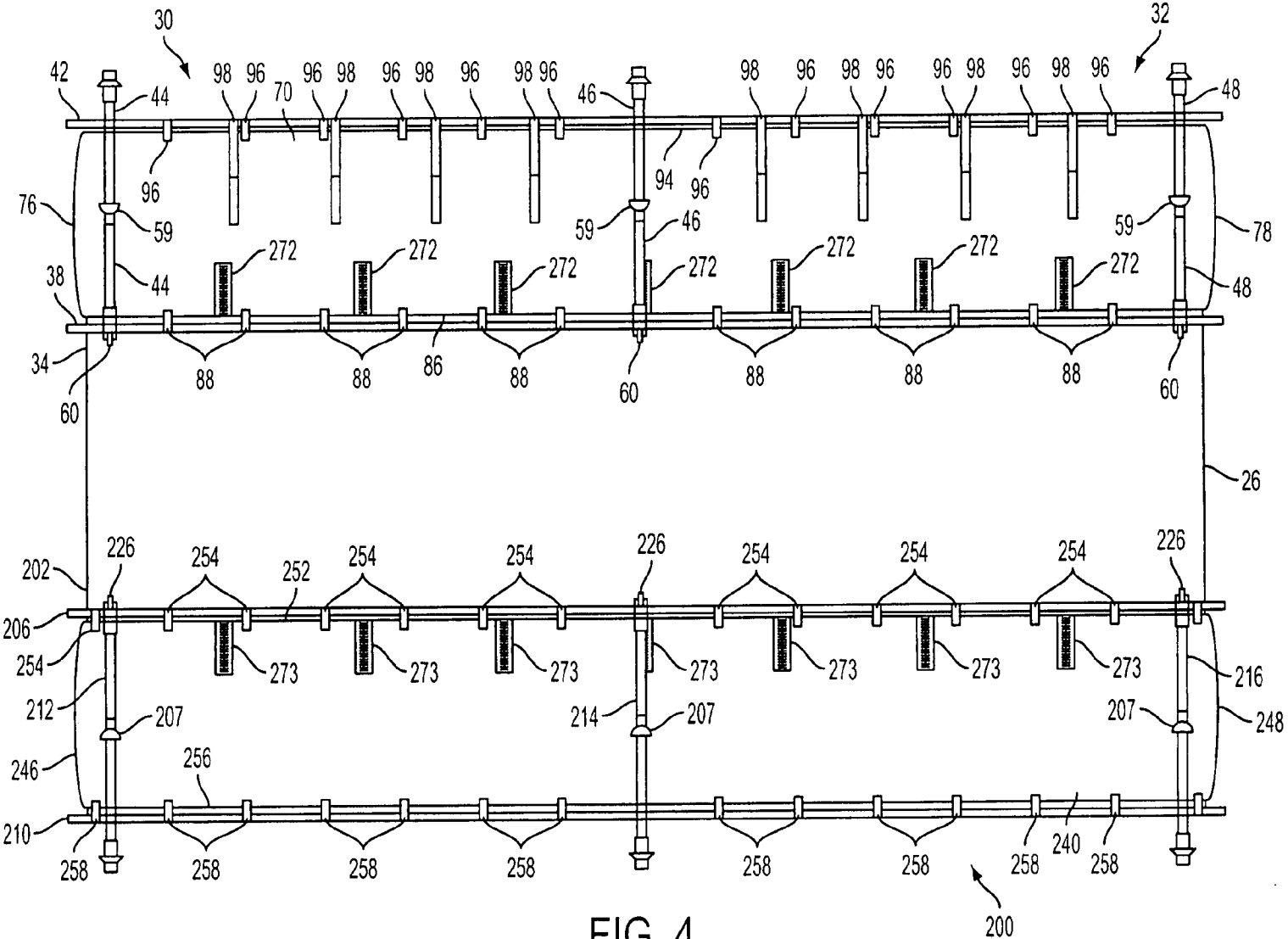
FIG. 4 is a top view of the present invention attached to a symbolic representation of an air cooler.

For this exemplary embodiment, and as shown in FIGS. 3–4, the housing 36 has a top portion 70 and a lower portion 72, the lower portion having a bottom 74, first and second sides 76,78 first and second access portions 80,82 and a drain 84. Second access portion 82 is shown on FIG. 5 and FIG. 6. The housing is open on the back side and is sized to encompass the air cooler frame inlet header 34. The housing top portion has a rear edge 86 with hoops 88 spaced along the rear edge length. When the housing open back side is placed over the air cooler frame inlet header, the first transverse member 38 is threaded through the hoops 88. Similarly, and as shown in FIG. 7, the housing lower portion bottom has a rear edge 90 with hoops 92 spaced along the rear edge length. When the housing open back side is placed over the air cooler frame inlet header, the second transverse member 40 is threaded through the hoops 92.

In this exemplary embodiment, and as shown in FIGS. 3–4, the housing top portion 70 has a front edge 94 with hoops 96 spaced along the length of the front edge. Third transverse member 42 is threaded through such hoops, and cooperates with the first transverse member 38 to suspend the housing top portion 70.

As shown in FIG. 4, eight closable straps 98 are spaced along the length of the housing top portion and extend beyond the housing top portion front edge 94. The housing lower portion first and second access portions 80,82 each have top edges 100,102, with rings 104 spaced along such edges to receive the eight closable straps 98. Second access portion 82 is shown on FIG. 5 and FIG. 6. When a closable strap 98 is threaded through a ring 104 it is draped back over the housing top portion 70 to close, thus pulling the first and second access portion top edges 100,102 to a first position. For example when the closable straps 98 on the top portion are threaded through the corresponding rings 104 on the first access portion top edge, and the strap is pulled reasonably tight for closure, the second access portion 82 will be generally vertical and its top edge 102 will be substantially adjacent the housing top portion front edge 94. In this position the second access portion will block access to the air cooler inlet header 34 and the holes in such header through which the line mole is inserted. Such access is only blocked, however, for the inlet header holes proximate the second access portion. All such inlet header holes are blocked only when both the first and second access portions are secured by the closable straps in this manner.

When preparing to close the closable straps 98, such straps can be routed over or under the third transverse member 42, in preparation for closing to the housing top portion 70.

Figure 6:
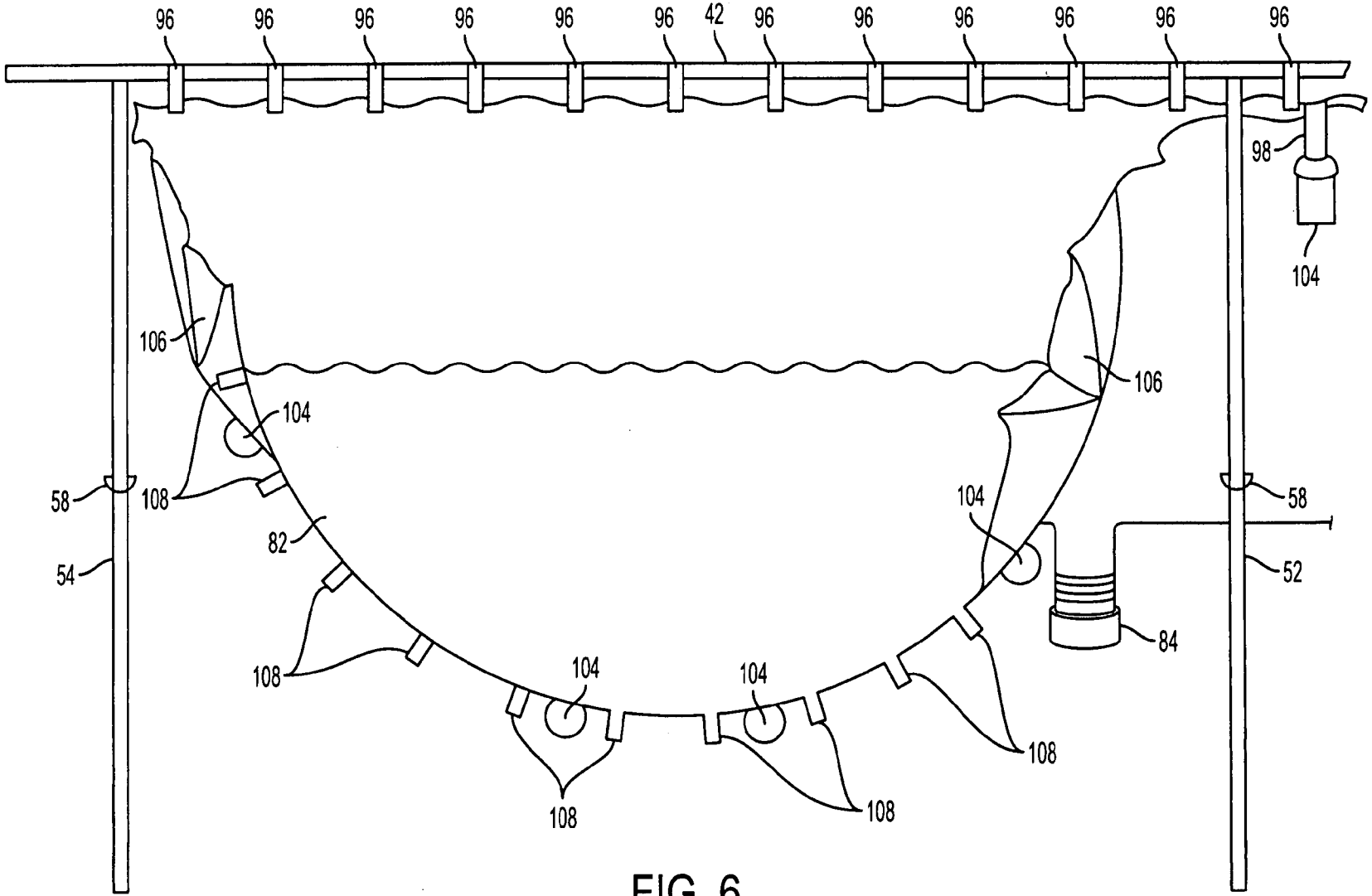
FIG. 6 is the view of FIG. 5 with one of the first enclosure housing lower portion access portions lowered.
Figure 7:
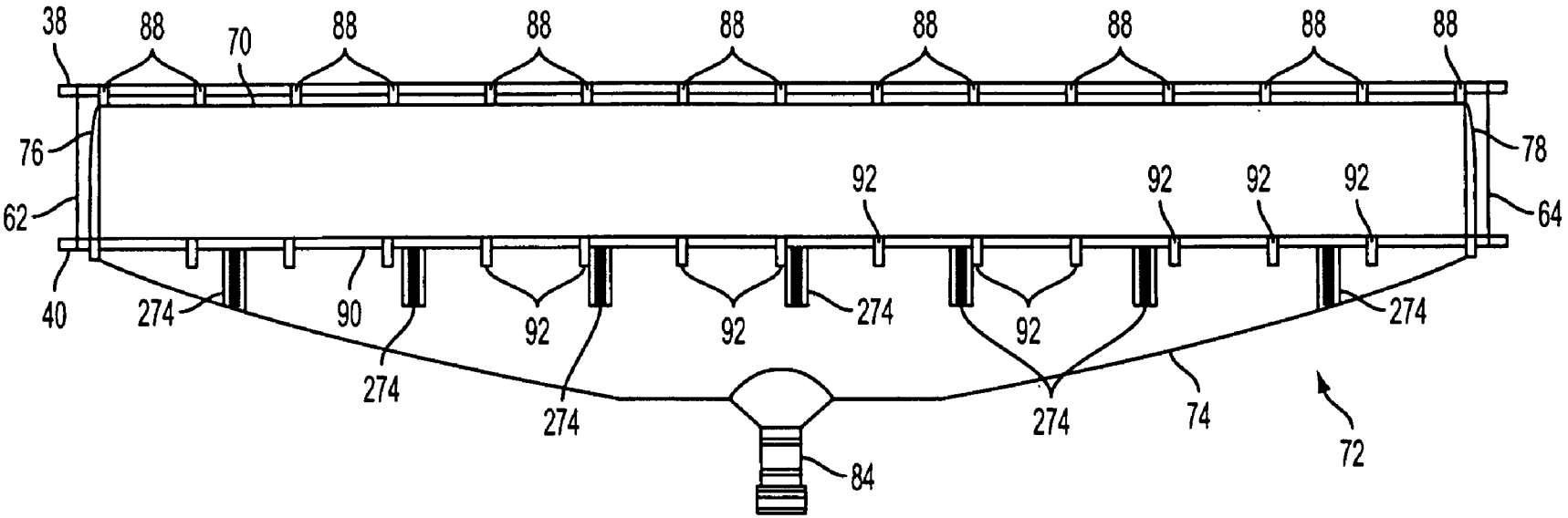
FIG. 7 is a view of the first enclosure of the present invention, the view taken in the opposite direction as the view of FIG. 5. The air cooler is removed from this view.

In this exemplary embodiment, and as shown in FIG. 6, either of the housing lower portion access portions 80,82 can be lowered to provide access to the air cooler inlet header 34 and its holes, but only those holes proximate the lowered access portion. In FIG. 6, for example, the second access portion 82 has been lowered by opening the four closable straps 98 that were threaded through the rings 104 on the second access portion's top edge 102, and removing the straps from those rings. Both the first and second access portions have pleats 106 that allow each to expand and drop a significant distance while the other remains generally vertical.

FIG. 6 also illustrates hoops 108 positioned proximate the top edges 100,102 of the first and second access portions 80,82, and spaced along the lengths of such top edges. A rod 103, of the type shown in FIG. 10 can be inserted by the operator through such hoops 108. The rod in this exemplary embodiment will be approximately as long as the first or second access portion is wide. When inserted it will straighten the top edge of the access portion, substantially removing the curved orientation of the access portion depicted in FIG. 6.

In this exemplary embodiment, the first enclosure housing bottom 74 is shaped to drain the housing lower portion 72, such that all accumulated liquids are drained through the housing drain 84.

The exemplary embodiment depicted in FIGS. 3–9 includes a second enclosure 200 attached to the air cooler frame outlet header 202 (i.e. the air cooler frame second end). The second enclosure has a frame and flexible housing 204 supported by the frame. In this exemplary embodiment, the second enclosure frame includes three horizontally-oriented, transverse, elongated members 206,208,210, three horizontally-oriented, telescoping, elongated members 212, 214,216 positioned in general alignment with the fin tubes, and three vertically-oriented, telescoping, elongated members 218,220,222, each hinged to one of the aligned members 212,214,216 to form three hinged legs.

Figure 5:
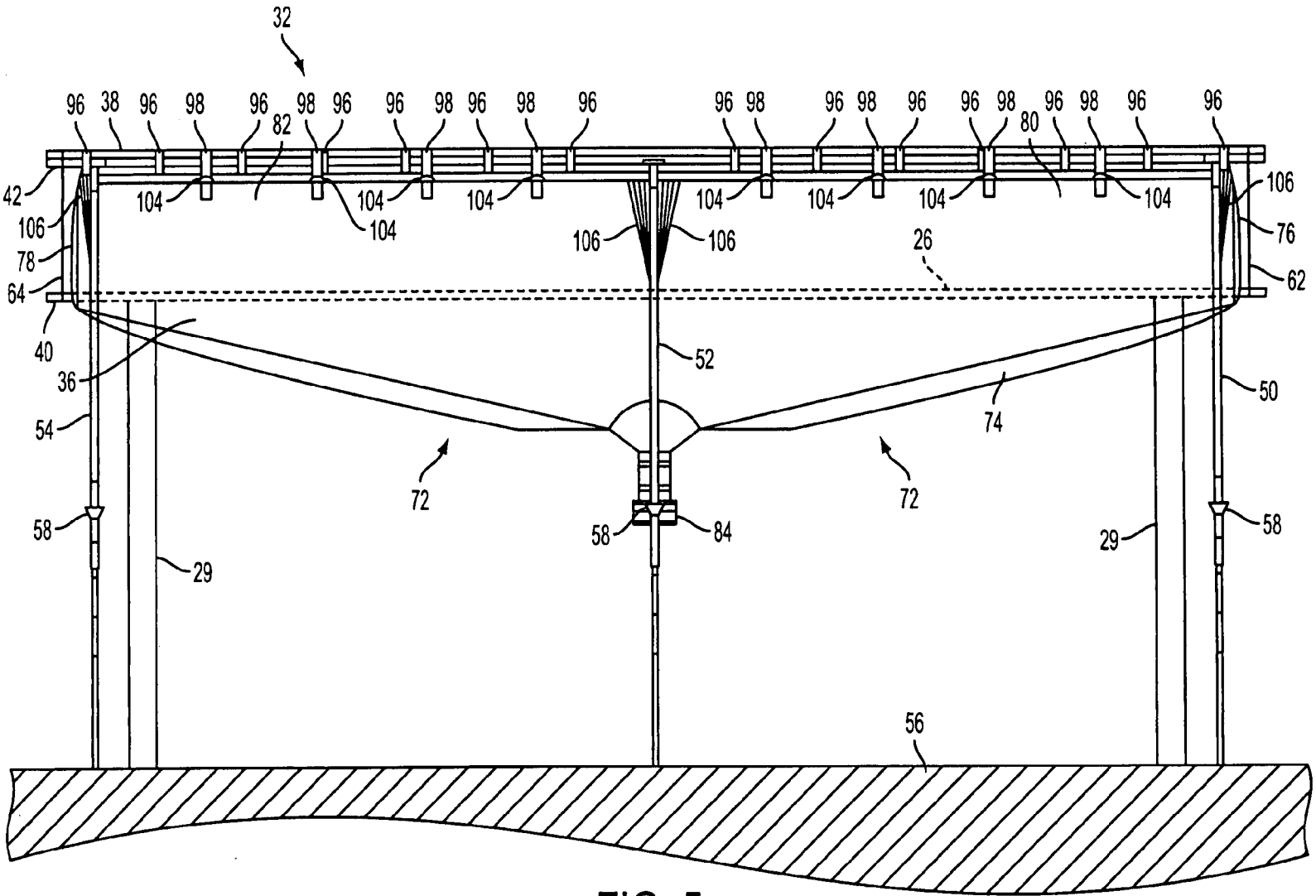
FIG. 5 is an end view of the first enclosure of the present invention attached to a symbolic representation of an air cooler.
Figure 8:
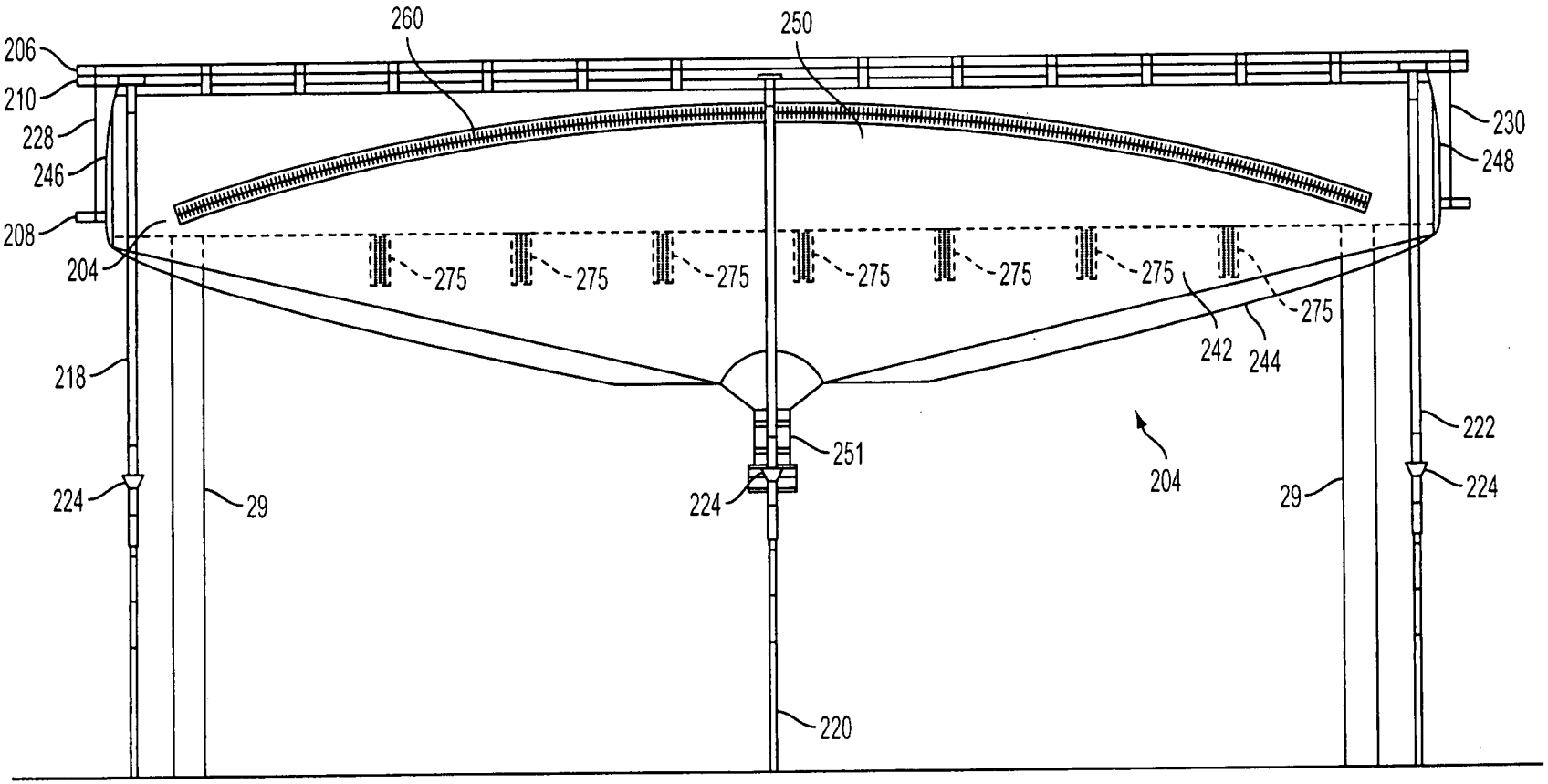
FIG. 8 is an end view of the second enclosure of the present invention attached to a symbolic representation of an air cooler.
Figure 9:
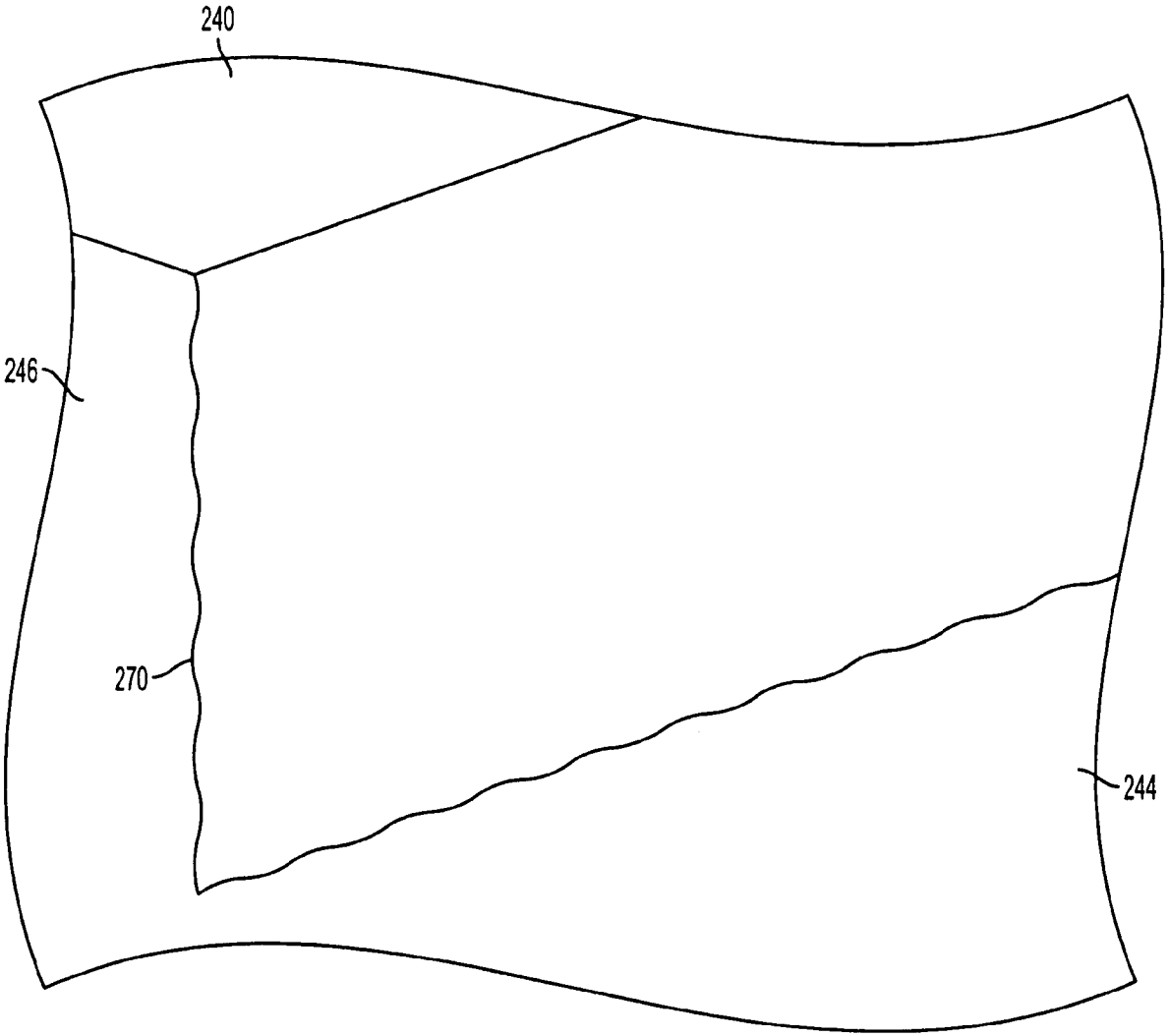
FIG. 9 is a partial interior view of the second enclosure of the present invention showing the drape within the second enclosure.

In such an embodiment, and as shown in FIGS. 4–5 and FIG. 8, the hinged legs extend vertically to the ground and can be telescopically adjusted by removing pins 224 and reinserting after telescoping the vertical members 218,220, 222. When the vertical members are properly adjusted, the horizontally-oriented aligned members 212,214,216 extend over the top of the second enclosure housing 204 where they are each fastened to the first transverse member 206 using pins 226. The aligned members 212,214,216 can be telescopically adjusted by removing pins 207 and reinserting after telescoping the aligned members to the desired length.

In this exemplary embodiment, the second enclosure frame first transverse member 206 is positioned adjacent the air cooler frame second end top. The second transverse member 208 is positioned against the air cooler frame second end bottom. The first and second transverse members 206,208 are held in such position by binding the first ends of such members with a first elastic member 228 and the second ends of such members with a second elastic member 230. In this exemplary embodiment the first and second elastic members used are typically referred to as "bungee" cords, although other support straps or retainers can be used.

For this exemplary embodiment, and as shown in FIGS. 3–4 and FIG. 8, the second enclosure housing 204 has a top portion 240 and a lower portion 242, the lower portion having a bottom 244, first and second sides 246,248, a front side 250, and drain 251. In this embodiment, the top portion 240 is continuous with the front side 250, with no separation. The housing is open on the back side and is sized to encompass the air cooler frame second end 202. The second enclosure housing top portion has a rear edge 252 with hoops 254 spaced along the rear edge length. When the second enclosure housing open back side is placed over the air cooler frame second end, the first transverse member 206 is threaded through the hoops 254. Similarly, and in the same fashion as shown in FIG. 7 for the first enclosure housing lower portion bottom 74, the second enclosure housing lower portion bottom 244 has a rear edge 243 with hoops 245 spaced along the rear edge length. When the second enclosure housing open back side is placed over the air cooler frame second end, the second transverse member 208 is threaded through the hoops.

In this exemplary embodiment, and as shown in FIGS. 3–4 and FIG. 8, the second enclosure housing top portion 240 has a front edge 256 at the joinder of the housing front side 250 and housing top portion, the front edge having hoops 258 spaced along the length of the front edge. Second enclosure third transverse member 210 is threaded through such hoops, and cooperates with the first transverse member 206 to suspend the second enclosure housing top portion 240.

In this exemplary embodiment, the second enclosure housing bottom 244 is shaped to drain the housing lower portion 242, such that all accumulated liquids are drained through the second enclosure housing drain 251.

In some exemplary embodiments, an access mechanism is provided to gain access to the interior of the second enclosure, without removing the frame from the air cooler second end. In the embodiment shown in FIG. 8, the access mechanism is a zipper 260 extending in a low arch across substantially all of the second enclosure housing front side 250. By unzipping the access mechanism, the operator gains access to the interior of the second enclosure.

In some exemplary embodiments of the present invention a splash control member is provided to such that cleaning fluids and dislodged materials exiting the air cooler frame second end will strike the splash-control member. In embodiments of the type shown in FIG. 9, the splash control member is a drape 270 in the second enclosure housing interior that extends across the width of the second enclosure lower portion 242.

In some exemplary embodiments, and as illustrated in FIG. 1, the air cooler frame first end 34 will have inlets 12 or other conduits that can potentially interfere with the first enclosure 32 as its open back side is being attached to the air cooler frame first end. As shown in FIG. 4, conduit accommodation mechanisms 272 are provided on the first enclosure housing proximate the housing top rear edge 86. In the exemplary embodiment shown in FIG. 4, the conduit accommodation mechanisms are zippered openings that can be opened to the extent needed to accommodate an inlet 12 and prevent the housing top 70 from crumpling or bunching as it encounters the inlet. Similarly, if the air cooler frame second end top should have a similar potentially interfering conduit, the conduit accommodation mechanisms 273 are provided on the second enclosure housing. In similar fashion, conduit accommodation mechanisms 274, shown in FIG. 7, are provided for the first enclosure for interfering conduits on the bottom of the air cooler first end, and conduit accommodation mechanisms 275, shown in FIG. 8, are provided for the second enclosure for interfering conduits on the bottom of the air cooler second end.

In some exemplary embodiments of the type shown in FIGS. 3–9, the first enclosure first and second transverse members 38,42 and the second enclosure first and second transverse members 206,210 are encompassed along at least a portion of their lengths by a compressible sheath, the compressible sheath providing a seal between such transverse members and the air cooler first and second ends 34,202.

Figure 10:
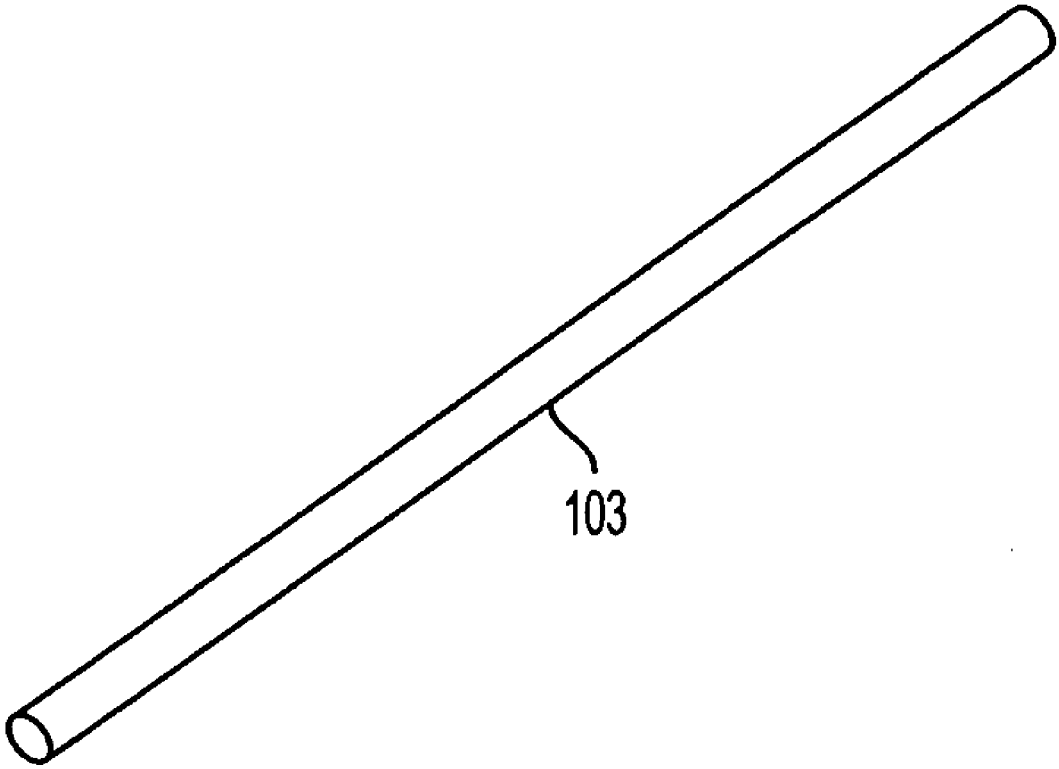
FIG. 10 is a perspective view of a rod for straightening the top edge of an opened first or second access portion.

When the device is attached to the air cooler frame as described above, both first housing access portions are closed, and the second housing access mechanism is closed, the operator begins the cleaning process by opening one of the access portions while leaving the other closed. If desired, the access portion rod of FIG. 10 is inserted in the access portion top edge hoops to straighten the top edge. By opening the first access portion, a number of the air cooler frame first end holes (inlet header holes) are exposed. Once the bull plugs are removed from such first end holes, the operator can then insert the line mole through one of the air cooler frame first end holes (inlet header holes) and into one of the fin tubes and begin discharging cleaning fluid into the fin tube.

The cleaning fluid and dislodged materials exit the fin tube being cleaned, are caught by the second housing, and are drained from the second housing through its drain. When the operator has repeated this for all the fin tubes exposed when the first housing first access portion was lowered, the operator then closes the first access portion using the closable straps. The second access portion is then lowered by opening the closable straps, and the remaining air cooler frame first end holes are exposed. If desired, the access portion rod of FIG. 10 is inserted in the access portion top edge hoops to straighten the top edge. The bull plugs are removed from such holes and the cleaning device is inserted through each hole into the fin tube corresponding to the hole. As the fin tube is cleaned the cleaning fluid and dislodged materials from the fin tube are caught by the second housing portion and are drained from the second housing portion through its drain. Once all fin tubes have been cleaned the second access portion can be closed using the closable straps, and the first and second housings can be removed. Bull plugs are then replaced in the air cooler frame first end holes. Alternatively, bull plugs can be replaced prior to closing the access portion.

In the exemplary embodiment of FIGS. 3–9, the first and second enclosure frame members are made of a rigid metal materials, e.g. aluminum, steel and the like, and the first and second enclosure flexible housings 36,204 are made of a coated vinyl (approximately 22 ounces per square yard). Hoops 88,92,96,245,254,258 are nylon, and the compressible sheath is made from foam rubber. The closable straps 98 are nylon with hook and pile fasteners of sufficient length to allow adjustable closing positions.

With respect to the above description then, it is to be realized that the optimum device configuration for the particular situation, will include variations in the device shape, size, and component materials that will occur to those skilled in the art upon review of the present disclosure.

All equivalent relationships to those illustrated in the drawings and described in the specification are intended to be encompassed by the present invention. The descriptions in this specification are for purposes of illustration only and are not to be construed in a limiting sense.

I claim:

1. For an air cooler to be cleaned by a cleaning apparatus having a fluid discharge end, a fluid containment apparatus for attachment to the air cooler, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, the apparatus comprising:

a first enclosure having a frame, a flexible housing having an interior, the housing being supported by the frame, and a drain member, the frame attaching the housing to the air cooler frame first end, the housing having a plurality of access portions, each access portion being openable to expose a number of the air cooler frame first end holes to cleaning apparatus discharge end entry, the flexible housing blocking such access to the remaining air cooler frame first end holes, such access portion being closable to block access to such exposed air cooler frame first end holes, the flexible housing being attached such that all cleaning fluid discharged from an air cooler frame first end hole is received by the housing and directed by the housing to the drain member; and a second enclosure having a frame, a flexible housing having an interior, the housing being supported by the frame, and a drain member, the frame attaching the housing to the air cooler frame second end such that cleaning fluid exiting one or more of the fin tube second ends through one or more of the air cooler frame second end holes is received by the housing and directed by the housing to the drain member.

2. The apparatus of claim 1, further comprising an access mechanism for providing access to the second enclosure housing interior, the access mechanism being openable and closable.

3. The apparatus of claim 1, further comprising a splash control member, the splash control member being positioned within the second enclosure housing interior and positioned such that cleaning fluid exiting one or more of the air cooler frame second end holes strikes the splash control member.

4. The apparatus of claim 1, wherein the air cooler frame first end has a top, and the air cooler further comprises a conduit member attached to the air cooler frame first end top, the first enclosure housing further comprising a conduit member accommodation mechanism, such that the conduit member is spatially accommodated by the conduit member accommodation mechanism when the first enclosure housing is attached to the air cooler frame first end.

5. The apparatus of claim 1, wherein the air cooler frame second end has a top, and the air cooler further comprises a conduit member attached to the air cooler frame second end top, the second enclosure housing further comprising a conduit member accommodation mechanism, such that the conduit member is spatially accommodated by the conduit member accommodation mechanism when the second enclosure housing is attached to the air cooler frame second end.

6. The apparatus of claim 1, wherein the air cooler frame first end has a bottom, and the air cooler further comprises a conduit member attached to the air cooler frame first end bottom, the first enclosure housing further comprising a conduit member accommodation mechanism, such that the conduit member is spatially accommodated by the conduit member accommodation mechanism when the first enclosure housing is attached to the air cooler frame first end.

7. The apparatus of claim 1, wherein the air cooler frame second end has a bottom, and the air cooler further comprises a conduit member attached to the air cooler frame second end bottom, the second enclosure housing further comprising a conduit member accommodation mechanism, such that the conduit member is spatially accommodated by the conduit member accommodation mechanism when the second enclosure housing is attached to the air cooler frame second end.

8. The apparatus of claim 1, wherein the first enclosure housing access portions are simultaneously openable such that all frame first end holes are exposed.

9. For an air cooler to be cleaned by a cleaning apparatus having a fluid discharge end, a fluid containment apparatus for attachment to the air cooler, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, the apparatus comprising:

means for enclosing the air cooler frame first end while providing openable separate access to each of at least two pluralities of the air cooler frame first end holes for the cleaning apparatus discharge end to enter, the means blocking such access to the remaining air cooler frame first end hole pluralities during access to a first of the pluralities, and to the first of the pluralities during access to a second of the pluralities, the means being attached such that all cleaning fluid discharged from an air cooler frame first end hole is received by, and drained from, such means; and means for enclosing the air cooler frame second end such that cleaning fluid exiting one or more of the fin tube second ends through one or more of the air cooler frame second end holes is received by such means and drained from such means.

10. The apparatus of claim 9, further comprising means for providing access to the means for enclosing the frame second end, such means for providing access being openable and closable.

11. The apparatus of claim 9, further comprising splash control means, the splash control means being positioned within the means for enclosing the frame second end and positioned such that cleaning fluid exiting one or more of the air cooler frame second end holes strikes the splash control means.

12. The apparatus of claim 9, wherein the air cooler frame first end has a top, and the air cooler further comprises a conduit member attached to the air cooler frame first end top, the means for enclosing the frame first end further comprising means for accommodating the conduit member, such that the conduit member is spatially accommodated by the means for accommodating the conduit member when the means for enclosing the frame first end is attached to the air cooler frame first end.

13. The apparatus of claim 9, wherein the air cooler frame second end has a top, and the air cooler further comprises a conduit member attached to the air cooler frame second end top, the means for enclosing the frame second end further comprising means for accommodating the conduit member, such that the conduit member is spatially accommodated by the means for accommodating the conduit member when the means for enclosing the frame second end is attached to the air cooler frame second end.

14. The apparatus of claim 9, wherein the air cooler frame first end has a bottom, and the air cooler further comprises a conduit member attached to the air cooler frame first end bottom, the means for enclosing the frame first end further comprising means for accommodating the conduit member, such that the conduit member is spatially accommodated by the means for accommodating the conduit member when the means for enclosing the frame first end is attached to the air cooler frame first end.

15. The apparatus of claim 9, wherein the air cooler frame second end has a bottom, and the air cooler further comprises a conduit member attached to the air cooler frame second end bottom, the means for enclosing the frame second end further comprising means for accommodating the conduit member, such that the conduit member is spatially accommodated by the means for accommodating the conduit member when the means for enclosing the frame second end is attached to the air cooler frame second end.

16. The apparatus of claim 9, wherein the means for enclosing the frame first end is optionally openable such that all frame first end holes are exposed.

17. For an air cooler to be cleaned by a cleaning apparatus having a fluid discharge end, the air cooler having multiple fin tubes aligned in a plurality of rows supported by a frame, the frame having a substantially rectangular first end and second end, the fin tubes each having a first end and a second end, the frame first and second ends each having a plurality of holes in a plurality of rows, the holes in the frame first being in substantial alignment with the fin tube first ends, the holes in the frame second end being in substantial alignment with the fin tube second ends such that the cleaning apparatus discharge end is insertable through one of the frame first end holes and into one of the fin tube first ends, such that cleaning fluids discharged within the fin tube exits the fin tube's second end, and further exits through one of the frame second end holes, a method for containing the cleaning fluids comprising:

enclosing the frame first end with a first enclosure;

enclosing the frame second end with a second enclosure for receiving cleaning fluid exiting one or more of the fin tube second ends through one or more of the air cooler frame second end holes, and draining the received cleaning fluid from the second enclosure;

opening a portion of the first enclosure to expose only a first plurality of the frame first end holes to cleaning apparatus discharge end entry and cleaning fluid discharge from the cleaning apparatus discharge end, the first enclosure continuing to block access to at least one additional pluralities of frame first end holes;

discharging cleaning fluid from the cleaning apparatus discharge end into each of the first plurality of frame first end holes, the first enclosure capturing and draining cleaning fluid discharged proximate the frame first end holes;

closing the opened portion of the first enclosure;

opening a portion of the first enclosure to expose only a second plurality of the frame first end holes to cleaning apparatus discharge end entry and cleaning fluid discharge from the cleaning apparatus discharge end, the first enclosure blocking access to the first plurality of frame first end holes and discharging cleaning fluid from the cleaning apparatus discharge end into each of the second plurality of frame first end holes, the first enclosure capturing and draining cleaning fluid discharged proximate the frame first end holes.

18. The method of claim 17, further comprising providing openable and closable access to within the second enclosure.

19. The method of claim 17, further positioning a splash control mechanism within the second enclosure such that cleaning fluid exiting one or more of the air cooler frame second end holes strikes the splash control mechanism.

20. The method of claim 17, wherein the air cooler frame first end has a top, and the air cooler further comprises a conduit member attached to the air cooler frame first end top, the method further comprising opening a conduit accommodation mechanism such that the conduit member is spatially accommodated by the first enclosure when the first enclosure encloses the air cooler frame first end.

21. The method of claim 17, wherein the air cooler frame second end has a top, and the air cooler further comprises a conduit member attached to the air cooler frame second end top, the method further comprising opening a conduit accommodation mechanism such that the conduit member is spatially accommodated by the second enclosure when the second enclosure encloses the air cooler frame second end.

22. The method of claim 17, wherein the air cooler frame first end has a bottom, and the air cooler further comprises a conduit member attached to the air cooler frame first end bottom, the method further comprising opening a conduit accommodation mechanism such that the conduit member is spatially accommodated by the first enclosure when the first enclosure encloses the air cooler frame first end.

23. The method of claim 17, wherein the air cooler frame second end has a bottom, and the air cooler further comprises a conduit member attached to the air cooler frame second end bottom, the method further comprising opening a conduit accommodation mechanism such that the conduit member is spatially accommodated by the second enclosure when the second enclosure encloses the air cooler frame second end.

24. The method of claim 17, further comprising, opening portions of the first enclosure such that all pluralities of frame first end holes are simultaneously exposed for cleaning apparatus discharge end entry.

* * * * *